US011052414B2

(12) United States Patent
Dambricourt

(10) Patent No.: US 11,052,414 B2
(45) Date of Patent: Jul. 6, 2021

(54) VALVE FOR AN END PIECE INCLUDING A SHUT-OFF DEVICE

(71) Applicant: CEP TUBES, Saint-Remy-sur-Durolle (FR)

(72) Inventor: Géry Dambricourt, Escoutoux (FR)

(73) Assignee: CEP TUBES, Saint-Remy-sur-Durolle (FR)

( * ) Notice: Subject to any disclaimer, the term of this patent is extended or adjusted under 35 U.S.C. 154(b) by 0 days.

(21) Appl. No.: 15/762,524

(22) PCT Filed: Sep. 22, 2016

(86) PCT No.: PCT/FR2016/052408
§ 371 (c)(1),
(2) Date: Jan. 30, 2019

(87) PCT Pub. No.: WO2017/051127
PCT Pub. Date: Mar. 30, 2017

(65) Prior Publication Data

US 2019/0151874 A1 May 23, 2019

(30) Foreign Application Priority Data

Sep. 22, 2015 (FR) ..... 1558938
Oct. 22, 2015 (FR) ..... 1560098

(51) Int. Cl.
*B05B 11/00* (2006.01)
*B65D 47/20* (2006.01)

(52) U.S. Cl.
CPC ..... *B05B 11/0072* (2013.01); *B05B 11/007* (2013.01); *B05B 11/0075* (2013.01);
(Continued)

(58) Field of Classification Search
CPC ..... B05B 11/3001; B05B 11/3069; B05B 11/3074; B05B 11/007; B05B 11/0075;
(Continued)

(56) References Cited

U.S. PATENT DOCUMENTS 1,987,156 A * 1/1935 Paparello ..... B65D 47/2081 222/494
5,447,258 A * 9/1995 Suzuki ..... B05B 11/007 222/341
(Continued)

FOREIGN PATENT DOCUMENTS

EP 1702862 A2 9/2006
EP 1702862 A3 8/2009
(Continued)

OTHER PUBLICATIONS

International Search Report and Written Opinion for PCT Patent App. No. PCT/FR2016/052408 (Jan. 24, 2017) in English.

*Primary Examiner* — Vishal Pancholi
*Assistant Examiner* — Bob Zadeh
(74) *Attorney, Agent, or Firm* — Kenealy Vaidya LLP

(57) ABSTRACT

Some embodiments are directed to a valve, including a rigid end piece that defines a center; a rod at the center of the end piece defining an axis; and a flap, wherein the flap is in one piece and has a flexible wall situated opposite a free end of the rod, the flexible wall is perforated by an orifice concentric with the end of the rod, the orifice has a contour substantially homothetic with that of the contour of the end of the rod in a plane perpendicular to the axis of the rod, the orifice has a surface below a projected surface of the end of the rod in the plane, the flap is connected to the end piece by a non-deformable fixed connection, and the flexible wall presses against the end of the rod at any point of its surface in contact with the end.

10 Claims, 9 Drawing Sheets

(52) U.S. Cl.
CPC ..... *B05B 11/3001* (2013.01); *B05B 11/3069* (2013.01); *B65D 47/2031* (2013.01); *B05B 11/3074* (2013.01)

(58) Field of Classification Search
CPC ..... B05B 11/0072; B65D 47/2031; G10H 1/0083; H01M 2220/30; H02J 7/0027; H02J 7/0045; H04B 1/034; H04B 1/3883; H04R 2420/07; H04R 3/00; Y02E 60/10
See application file for complete search history.

(56) References Cited

U.S. PATENT DOCUMENTS

| | | | | | |
|---|---|---|---|---|---|
| 6,145,707 | A * | 11/2000 | Baudin | B05B 11/0027 | 222/189.09 |
| 6,325,253 | B1 * | 12/2001 | Robinson | B65D 47/2081 | 222/212 |
| 6,443,370 | B1 * | 9/2002 | Brulle | B05B 1/3436 | 239/333 |
| 2015/0335475 | A1 * | 11/2015 | Lamboux | B65D 47/18 | 604/521 |
| 2019/0076862 | A1 * | 3/2019 | Dambricourt | B65D 47/2031 | |

FOREIGN PATENT DOCUMENTS

| | | | | |
|---|---|---|---|---|
| FR | 2785878 | A1 * | 5/2000 | B65D 83/7535 |
| FR | 2895734 | A1 | 7/2007 | |

* cited by examiner

VALVE FOR AN END PIECE INCLUDING A SHUT-OFF DEVICE

CROSS REFERENCE TO RELATED APPLICATIONS

This application is a national phase filing under 35 C.F.R. § 371 of and claims priority to PCT Patent Application No. PCT/FR2016/052408, filed on Sep. 22, 2016, which claims the priority benefit under 35 U.S.C. § 119 of French Patent Application No. 1558938, filed on Sep. 22, 2015, and French Patent Application No. 1560098, filed on Oct. 22, 2015, the contents of each of which are hereby incorporated in their entireties by reference.

BACKGROUND

Some embodiments relate to a valve housed in the outlet nozzle of an airless dispensing system, i.e. one without air intake, assembled on a container in which a fluid product is packaged. Some of these embodiments specifically relate to an outlet duct that opens out onto an outlet orifice, the valve shutting off the outlet orifice when the dispensing system is not delivering the product packaged in the container.

The nozzle equipped with such a valve is commonly referred to by the term shut-off nozzle.

Airless dispensing systems are designed to impede or prevent the product packaged in the container from coming into contact with the air before it is dispensed. They are used to dispense fluid, liquid or pasty products which must or should not be in contact with the air before they are used, for example—without being limited thereto—pharmaceutical or cosmetic products.

These dispensing systems are generally equipped with a non-return pump for ensuring metering and allowing the evacuation of the product packaged in the container. The packaged product flows from the container to the pump, and then from the pump to the evacuation orifice under the effect of the movement impressed on the pump by a push button.

SUMMARY

The pump is normally equipped with an inlet valve and an outlet valve for the operation thereof. At rest, when the dispenser is not being used, the valves are closed. The packaged product is thus not in contact with the air from the container to the outlet valve of the pump.

When the outlet orifice is not shut off, the product housed in the evacuation duct situated between the outlet valve of the pump and the outlet orifice of the dispenser is exposed to the air, this representing a considerable drawback since the packaged products must or should not be in contact with the air.

The presence of a system—known as a shut-off nozzle—for automatically shutting off the evacuation orifice when the dispensing system is at rest eliminates this drawback.

Related art shut-off systems have the drawback of being expensive and fragile when they are made up of moving elements, or of being somewhat ineffective when they are made up of two flexible lips pressing against one another, on account of the absence of control of the directiveness of the outlet jet of packaged product and the poor quality of the air barrier arising from the pressing of the lips against one another.

Some embodiments are therefore directed to a shut-off nozzle equipped with a valve that is much more simple and thus much more reliable and inexpensive than a moving shut-off valve, while having an air barrier property that is as effective as the barrier afforded by the moving shut-off valves. In addition, the valve of some embodiments therefore afford excellent directional control of the outlet jet of packaged product.

The valve according to some embodiments is made up of a rigid nozzle having at its centre a stem of axis xx', and of a flap, wherein:

- the flap is in one piece and has a flexible wall situated facing a free end of the stem,
- the flexible wall is perforated by an orifice that is concentric with the end of the stem,
- the orifice has a contour that is substantially homothetic with the contour of the end of the stem in a plane P perpendicular to the axis xx' of the stem,
- the orifice has an area smaller than a projected area of the end of the stem in the plane P,
- the valve is in a closed position when the flexible wall is in contact with the end of the stem around the entire perimeter of the orifice, and in an open position when the flexible wall is away from the end of the stem around at least a part of the perimeter of the orifice,
- the flap and the stem make up a leaktight assembly when the flexible wall is in contact with the end of the stem around the entire perimeter of the orifice,
- the flap is connected to the nozzle by a non-deformable fixed connection,
- the valve passes from the closed position to the open position by deformation of the flexible wall,
- the flexible wall presses against the end of the stem at all or most points of its surface in contact with the end, and
- the pressing is obtained by elastic deformation of the flexible wall, the deformation resulting from the assembly of the flap and the nozzle, and
- the flexible wall is inscribed in a substantially flattened convex cone of revolution, coaxial with the axis xx', the angle of the wall with the axis xx' being between 90° and 135°, advantageously between 90° and 120°, when the flexible wall is pressing against the end of the stem. The axis xx' is directed in the direction of flow of the product from the inside of the nozzle to the outside. The angle of the wall is measured as illustrated in FIG. 3. When the angle is between 90° and 135°, as illustrated in FIG. 3, the flexible wall has a convex conical shape.

The rigid wall can be directed towards either the inside or the outside of the cavity.

Therefore, the valve according to some embodiments includes a flap housed in the cavity that the outlet duct forms when it opens out onto the outlet orifice of the dispensing system.

The term "valve" will be used in the rest of the description for the assembly combining the outlet nozzle of the dispensing system and the flap housed in the nozzle to realize a nozzle known as a shut-off nozzle.

The valve is thus closed in a leaktight manner in the rest position. The elastic deformation of the flap means that it presses, that is to say presses in a preloaded manner, against the rigid wall of the stem. The opening and closing of the passage for the product are obtained by the complementary deformation and thus the movement of the flexible wall along the axis xx' under the effect of the pressure of the product arising from the setting of the pump into motion.

Advantageously, the stem is disposed inside—substantially at the centre of—a cavity pierced by a first opening, the free end of the stem being disposed at the centre of the first opening, the first opening being inscribed in a plane substantially perpendicular to the axis xx'. The product may thus flow to the outside, the cavity and the first opening forming the end of the outlet duct and the evacuation orifice of the system for dispensing the product.

Advantageously, the flap is equipped with a hollow shaft, a first end of which is joined to a peripheral region of the flexible wall, the flap is fixed to the nozzle by the hollow shaft being fitted into the cavity along the axis xx', an outer face of the hollow shaft and an inner face of the wall of the cavity describing a substantially annular axisymmetric shape cooperating with one another, the outer face pressing in a leaktight manner against the inner face of the wall of the cavity, the stem being disposed inside the hollow shaft after assembly, the stem and the hollow shaft then being substantially coaxial and concentric. The flap is thus mounted simply on the nozzle by being fitted in the cavity.

Advantageously, the flap forms a one-piece assembly, the flap being made of an elastic polymer with shape memory. The fact that the flap is fixed and in one piece reduces the number of parts, the connection between the flap and the nozzle being produced without any complementary assembly part.

Since the flap is made of elastic polymer with shape memory, the deformation of its flexible wall during fitting creates a pressure thereof on the rigid wall of the stem and allows not only the leaktightness thereof to be ensured at rest, but also allows it to return automatically into the pressing position after the product metered in the pump has been evacuated to the outside.

Advantageously, the nozzle forms a one-piece assembly. The nozzle is thus made up of the stem and of the cavity situated at the end of the evacuation duct, the opening of the cavity forming the outlet orifice for the product.

Advantageously, the flexible wall is flat when it is pressing against the end of the stem. The flexible wall can be substantially flat and substantially perpendicular to the axis xx' without departing from the scope of some embodiments. In this case, the flexible wall will have a cone shape, the generatrix of which exhibits an angle of less than 90° with the axis xx' before mounting (cone facing into the nozzle). The deformation resulting from the mounting and pressing against the end of the stem gives the wall a more or less flattened convex cone shape.

Advantageously, the orifice and the projection of the end of the stem in the plane P have a circular shape. This disposition ensures a more homogeneous passage at every point of the perimeter of the orifice when the valve is in the open position.

A traditional lipped shut-off member is made up of two lips pressing against one another in the form of a jaw. The shut-off member according to some embodiments is made up of a flexible wall perforated with an advantageously circular and central orifice that is kept pressed against a rigid wall in its peripheral region around the orifice. This disposition confers control and perfect or enhanced consistency on the pressing of the flexible wall against the rigid wall at every or nearly every point of the peripheral region. There is thus perfect or enhanced leaktightness, equivalent to that obtained by a complex and fragile shut-off system equipped with moving flaps. The system is optimized if the orifice is circular and the end of the stem is in the form of a circular cap.

According to some embodiments, the wall of the flap has a convex conical shape when it presses against the end of the stem, that is to say exhibits an angle of between 90° and 135° with the axis xx' as illustrated in FIG. 3. The complementary deformation of the flexible wall along the axis xx' under the effect of the pressure of the packaged liquid is an elastic deformation of the elongation in the vicinity of the orifice type, this bringing about a significant return force which ensures the leaktightness of the valve in the rest position after evacuation of the dispensed liquid.

The variability of the opening angle of between 90° and 135° makes it possible to optimize the closing force of the valve depending on the elasticity of a previously determined polymer.

Although, advantageously, the orifice and the projection of the end of the stem in the plane P have a circular shape, other shapes are possible for the orifice, for example a more or less flattened elliptical shape if the manufacturer desires a jet of product with a more or less flattened shape. It will then be appropriate to adapt the profile of the stem in the vicinity of its end to the shape of the orifice so as to maintain substantially constant pressing of the flexible wall at every point of the peripheral region around the orifice.

Some embodiments also relate to an airless dispensing system having a pump including a valve with at least one of the above features, acting as a shut-off nozzle integrated into the push button of the system, the product to be diffused being conveyed through a duct that is housed in the push button and opens into the cavity and then escaping via the orifice through a passage. The nozzle and the push button may form a one-piece assembly, this helping to further simplify the device and reduce the manufacturing costs thereof.

Advantageously, the airless dispensing system having a pump includes a valve with at least one of the above features, acting simultaneously as an outlet valve of the pump and as a shut-off nozzle. This possibility arises from the great quality of airtightness of the valve and makes it possible to further reduce the manufacturing costs of the dispensing system.

Some embodiments also relate to a device of the airless flexible tube type having an orifice, wherein the device includes a valve with at least one of the above features, the valve being housed in the orifice and forming a shut-off nozzle of the flexible tube. The flexible tube is another type of container, the volume of which is able to correspond, at any moment of its use, to the remaining volume of product that it contains. In a traditional mode of use, the orifice of the tube is open. When the user releases the pressure on the wall of the tube, air passes into the tube, completely or partially replacing the cream evacuated. During use, there is thus a large quantity of air in the tube, especially when the wall of the tube is provided with significant shape memory, which is often the case for tubes used to package care creams. In this second exemplary embodiment, the orifice of the flexible tube is equipped with a valve forming a shut-off nozzle. Thus, when the user presses on the flexible wall of the tube, the overpressure created in the tube opens the valve and opens up the passage through the orifice of the tube, and as soon as the user interrupts this pressure, the valve closes again, preventing or impeding the penetration of air into the tube. This application is thus highly advantageous in that it makes it possible to have an airless packaging without employing a pump, which is more expensive than the device, and the ergonomics of which are also ill-suited to joining to a container of the flexible tube type.

Advantageously, the nozzle also bears a second flexible flap fitted in the stem and pressing against a face situated facing the first opening, the second flap forming, with the nozzle, an additional non-return valve. The flexible tube thus has two barriers to the entry of air into the container, the two barriers being disposed "in series" with respect to one another.

According to a first variant, the tube includes a head and the nozzle forms a one-piece assembly housed in the orifice delimited by the wall of the head of the tube. Advantageously, the nozzle and the wall form a one-piece assembly.

According to a second variant, the tube includes a fixed cap with a base and the nozzle forms a one-piece assembly with the base. This embodiment is particularly economical since the rigid pressing walls and the device or fixer for fixing each flap are made in the one-piece base.

BRIEF DESCRIPTION OF THE FIGURES

Further advantages may also become apparent to one of ordinary skill in the art from reading the following examples, illustrated by the appended figures, which are given by way of illustration.

DETAILED DESCRIPTION OF EXEMPLARY EMBODIMENTS

For the rest of the description, the top will be considered to correspond to the orifice of the nozzle and the bottom will be considered to correspond to the part through which the product arrives and the interior will be considered to correspond to the middle of the nozzle.

Figure 1:
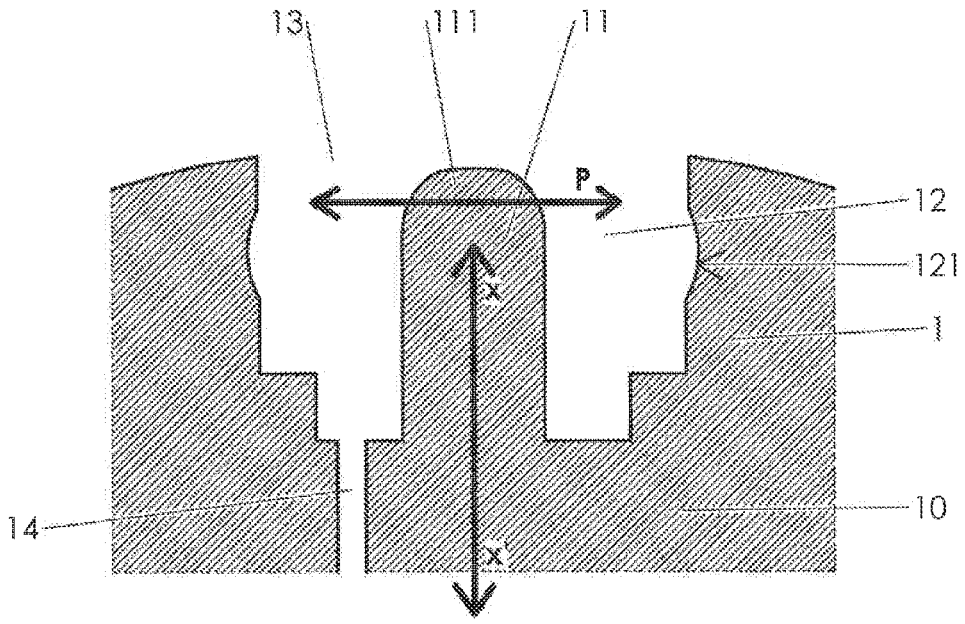
FIG. 1 is a cross section through the nozzle according to some embodiments.

The nozzle 1 illustrated in FIG. 1 is in one piece, and includes a stem 11 of axis xx' fixed to a body 10 and positioned in the centre of a cavity 12. This cavity 12 is pierced by a first opening 13 positioned in the top part and by a duct 14 that opens out in the bottom part of the cavity 12.

Figure 2:
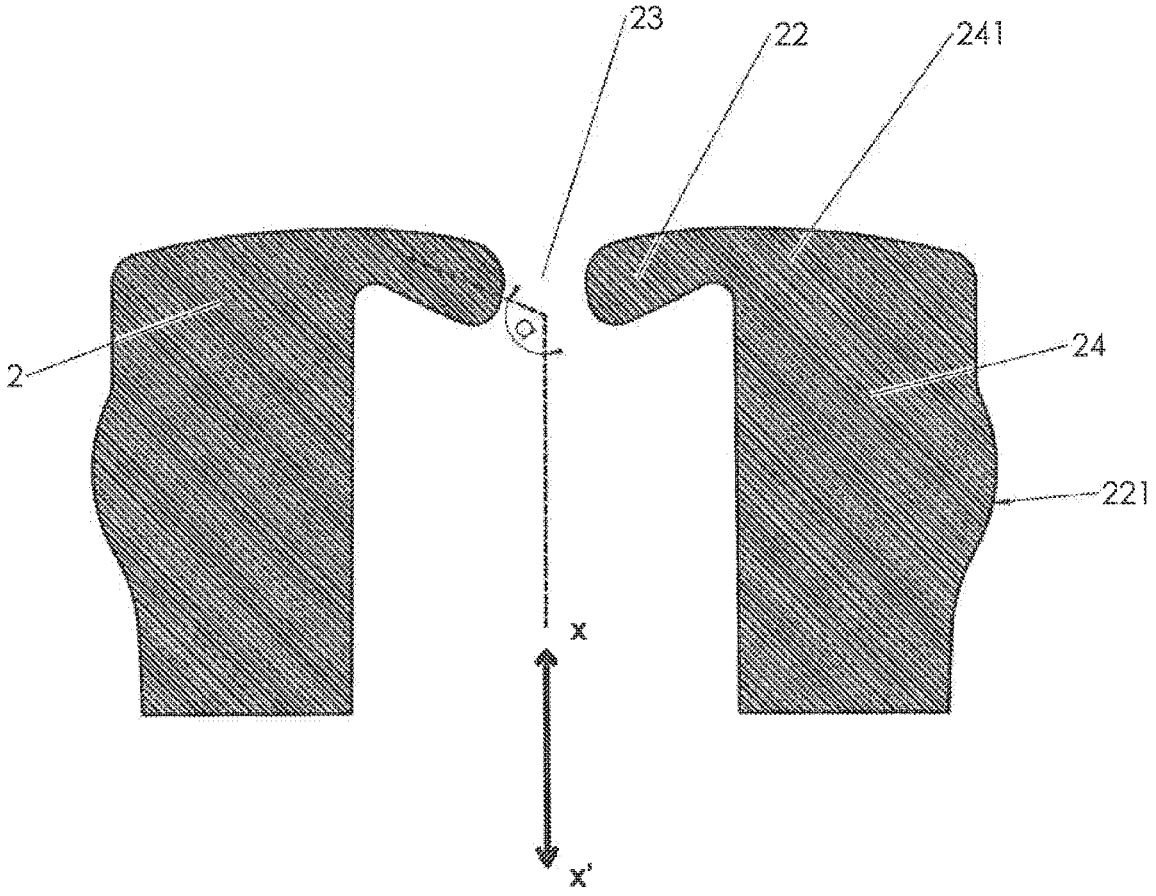
FIG. 2 is a cross section through the flap according to one embodiment before mounting on the nozzle (before deformation)

The flap 2 shown in FIG. 2 is also in one piece, and includes a flexible wall 22 pierced by an orifice 23 and a hollow cylindrical part of axis xx' in the form of a hollow shaft 24. The hollow shaft 24 has an outer face 221 intended to cooperate with the inner face 121 of the cavity 12. During the fitting of the flap 2 on the nozzle 1, the flexible wall 22 will deform, its inclination with respect to the axis xx' being modified.

The hollow shaft 24 has a first end 241 joined to a peripheral region of the flexible wall 22.

Figure 3:
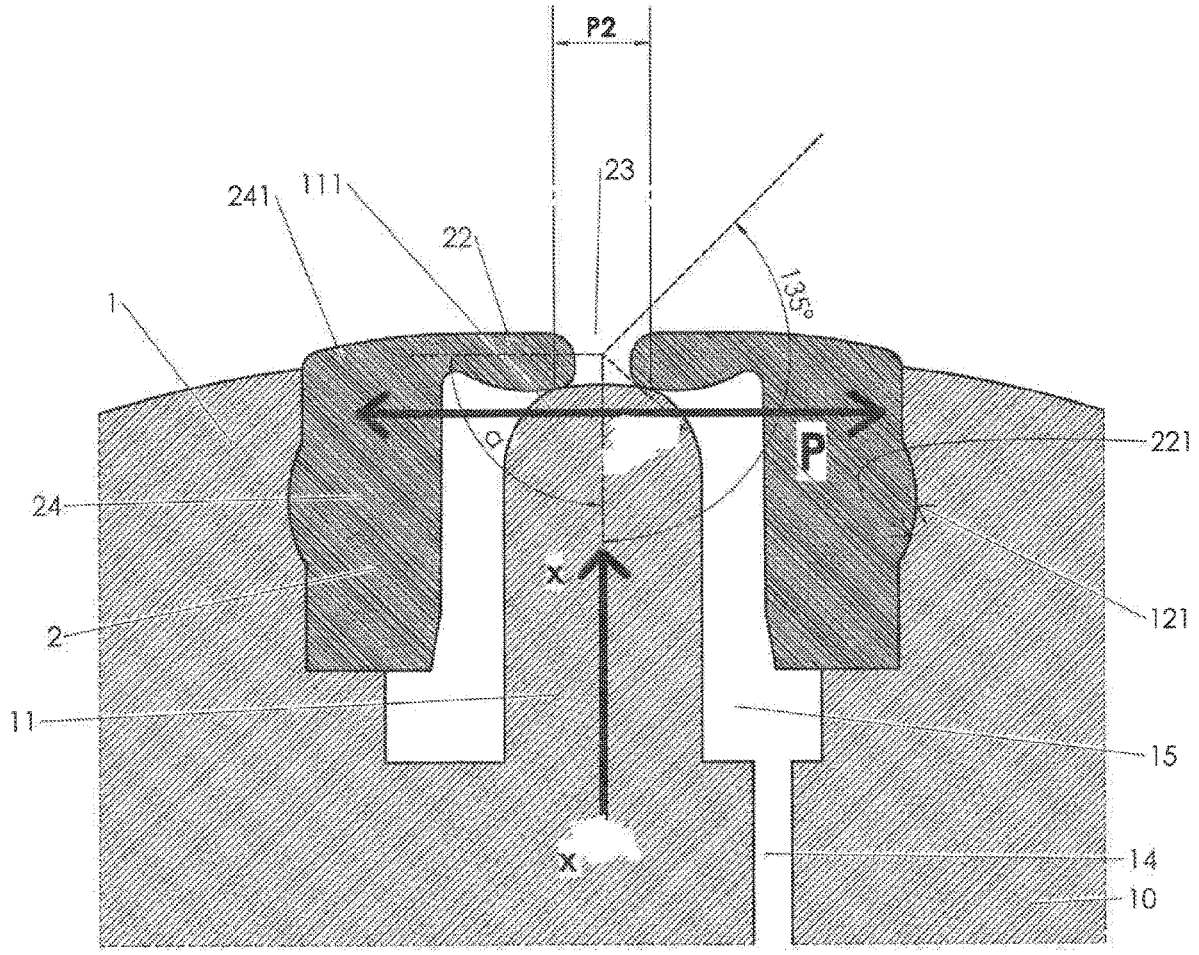
FIG. 3 is a cross section through the valve according to some embodiments.

As described in FIGS. 2 and 3, the flexible wall has an inclination directed towards the inside of the flap before mounting (FIG. 2). After mounting, the flexible wall has a flattened convex cone shape, i.e. exhibits an angle of between 90° and 135°, advantageously between 90° and 120°, with the axis xx' as illustrated in FIG. 3.

The mounted valve illustrated in FIG. 3 is made up of the nozzle 1 and the flap 2. The flap 2 is fitted in the cavity 12 and the outer face 221 of the flap presses against the inner face 121 of the cavity 12. The deformation of the flexible wall 22 during the fitting of the flap 2 has the effect of pressing the flexible wall 22 against the free end 111 of the stem, thereby ensuring the leaktightness of the nozzle 1 when the metered product has been evacuated.

In an embodiment (FIG. 7), the outer face 221 of the hollow shaft 24 of the flap presses against the face 121 of the cavity 12 and its inner face 222 presses against the flank 112 of the stem 11. The passage of product is ensured by a channel 113 made in the stem 11.

Of course, the stem 11 is solid on the side of its free end 111, i.e. does not have any passage in this entire region.

Figure 7:
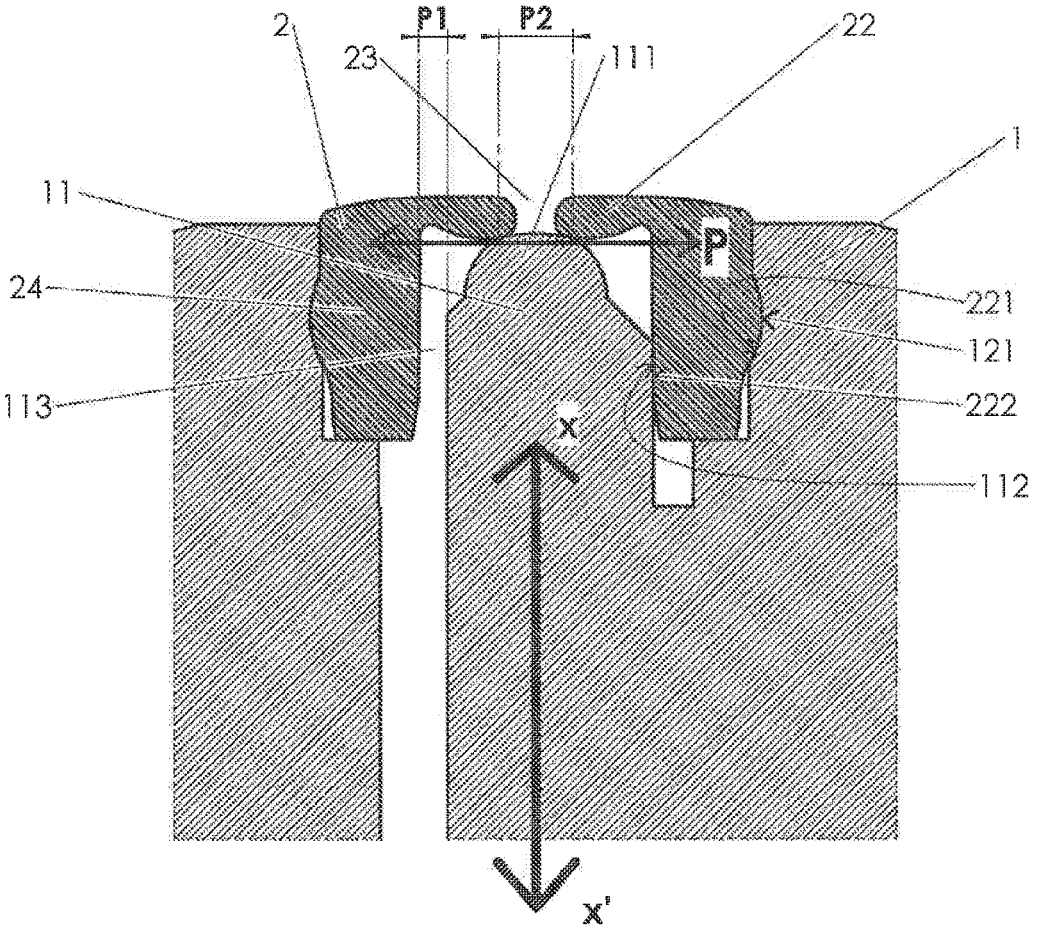
FIG. 7 is a cross section through a valve according to another embodiment.

In this embodiment, the channel 113 is situated away from the end 111 of the stem in a radial extension of the stem, as described in FIG. 7. The channel 113 is off-centre such that its projection P1 in the plane P is inscribed in a region situated outside the projection of the end 111, and thus outside the projection P2 of the region in which the lips 22 press against the end 111 in the plane P.

The functioning of the valve of some embodiments will now be described. At rest, i.e. when no action takes place on the nozzle 1, the flexible wall 22 is pressing, the pressure being substantially identical on both sides of the wall 22, and the nozzle 1 is leaktight, the product remaining in the passage 15 and the duct 14. When the user exerts a pressure on the product with the aid of a pump, the pressure of the product increases until it causes at least a part of the flexible wall 22 to lift, opens up the passage between the end 111 of the stem and the orifice 23 in the wall 22, and allows the output of the product. As soon as the product has come out, the pressure equalizes on both sides of the flexible wall 22, which returns to its rest position pressing against the end 111 of the stem.

When the flexible wall 22 has a flattened convex cone shape, i.e. forms an angle greater than 90° with the axis xx' as illustrated in FIG. 3, the opening of the passage between the end 111 and the wall 22 causes elastic deformation of the elongation of the wall 22 in the vicinity of the orifice type. This elongation creates a significant return force which ensures the leaktightness of the valve in the rest position after passage of the dispensed liquid.

The valve of some embodiments may be disposed at the end of an airless dispensing system equipped with a pump that fulfils the function of a shut-off nozzle of the dispensing system.

Figure 4:
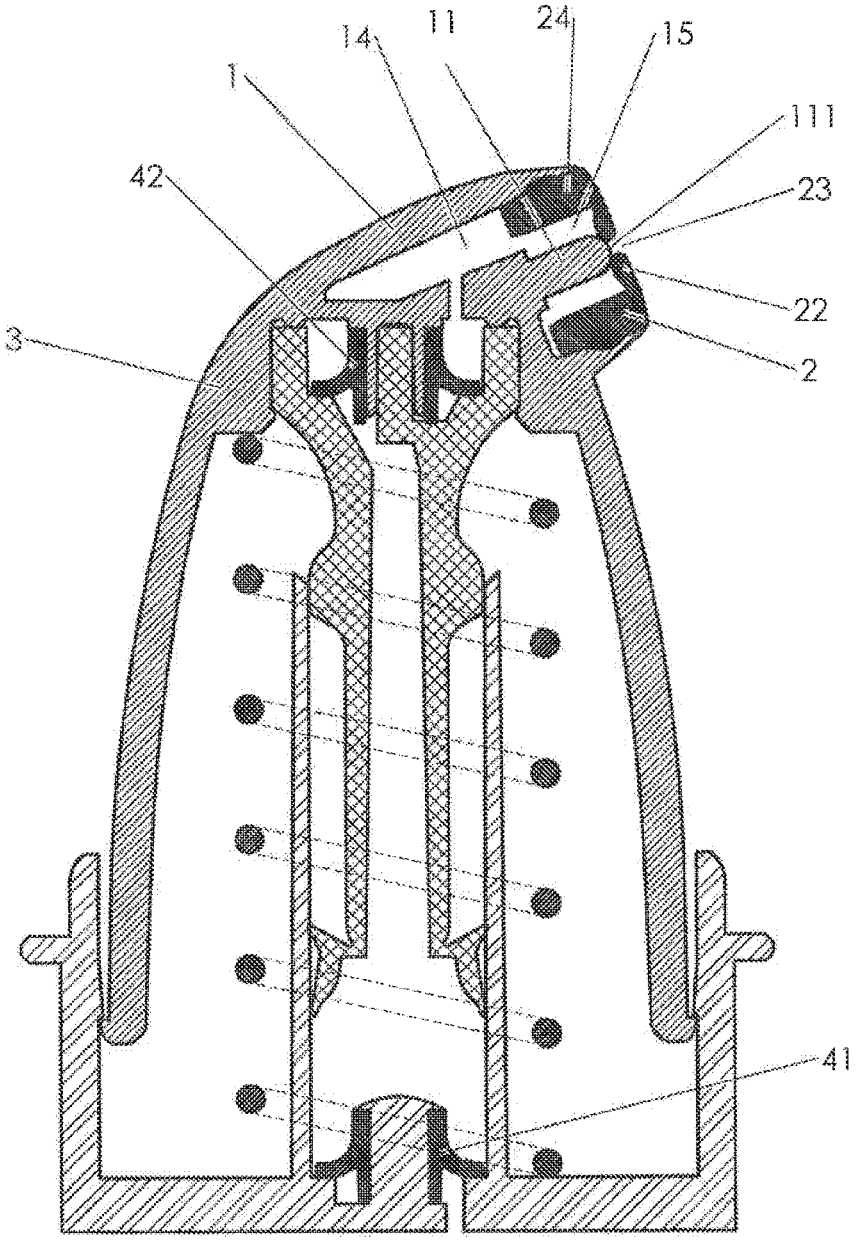
FIG. 4 is a cross section through an embodiment of a dispensing system equipped with the valve according to some embodiments.

In a first version illustrated in FIG. 4, the nozzle acts as a shut-off nozzle, the pump being equipped with an inlet valve 41 and an outlet valve 42.

Figure 5:
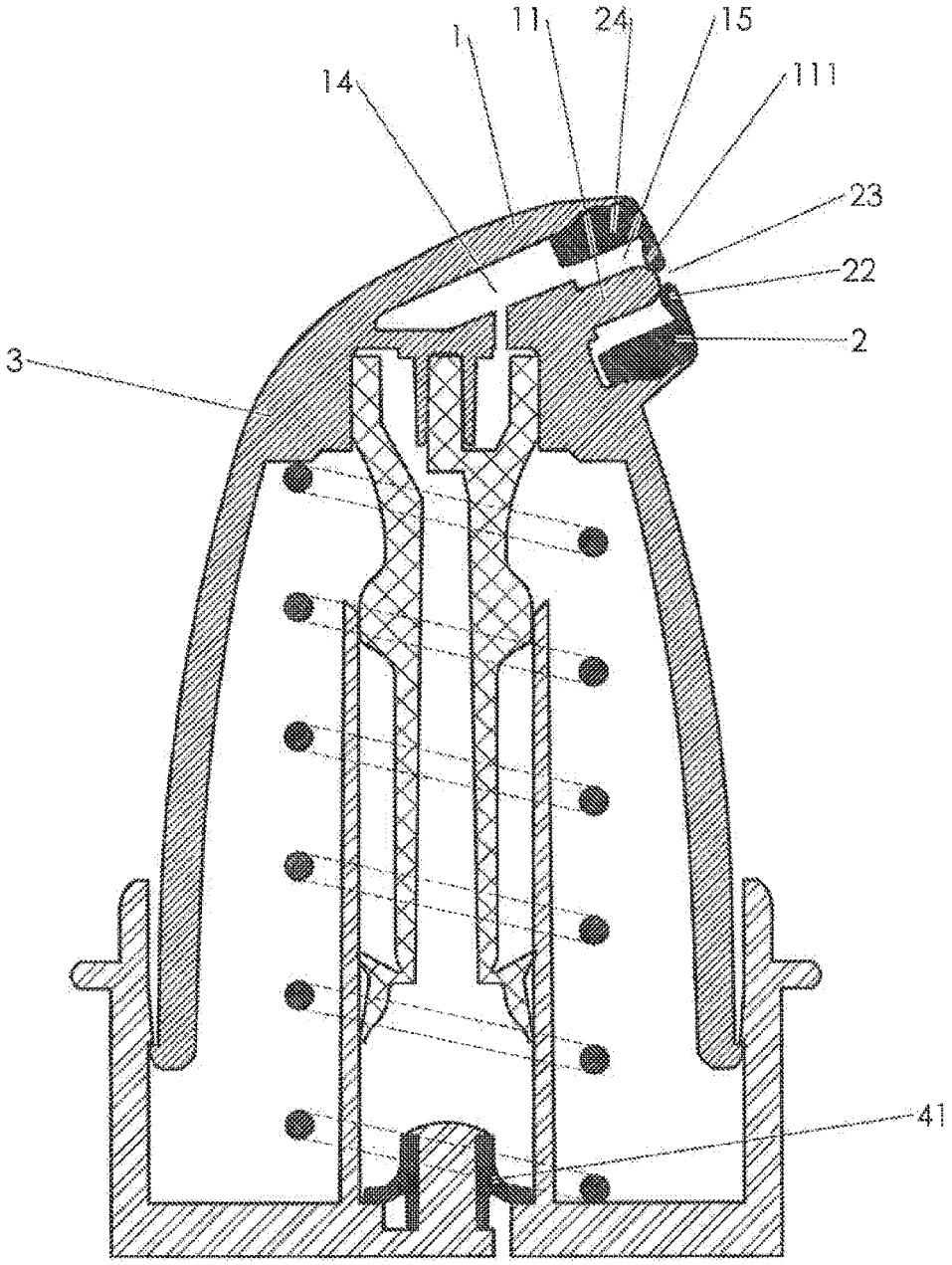
FIG. 5 is a cross section through another embodiment of a dispensing system equipped with the valve according to some embodiments.
Figure 6:
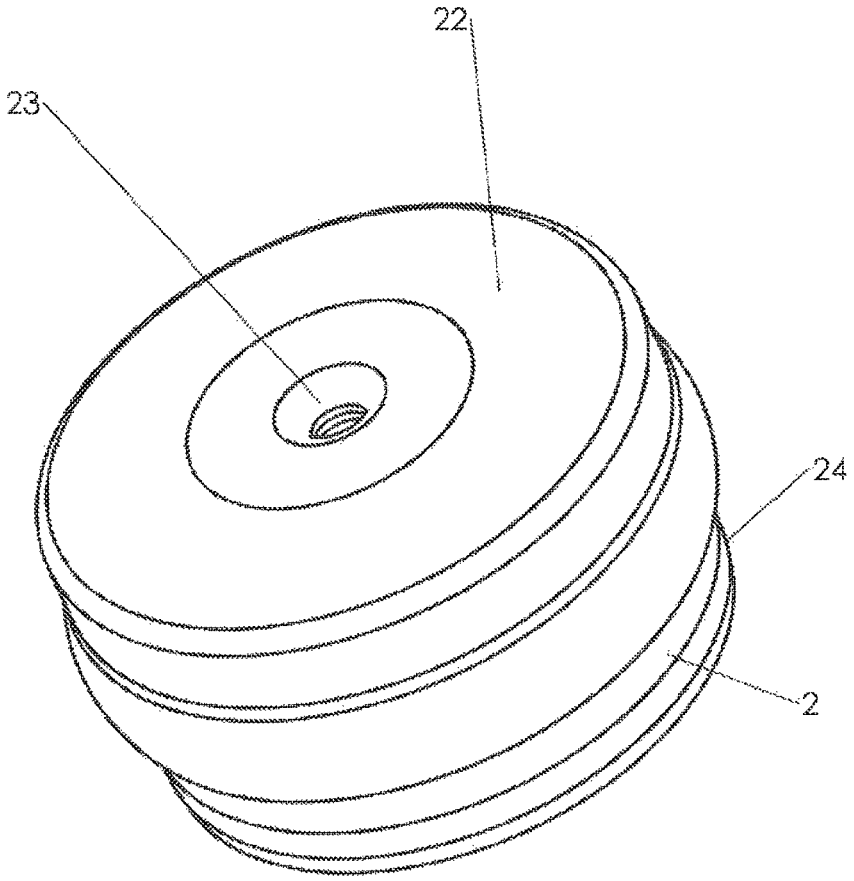
FIG. 6 is a perspective view of the flap.

In a second version illustrated in FIG. 5, the nozzle acts both as a shut-off nozzle and as an outlet valve of the pump, the pump only being equipped with a single inlet valve 41.

The valve of some embodiments can also act as a shut-off nozzle for an airless flexible tube.

Figure 8C:
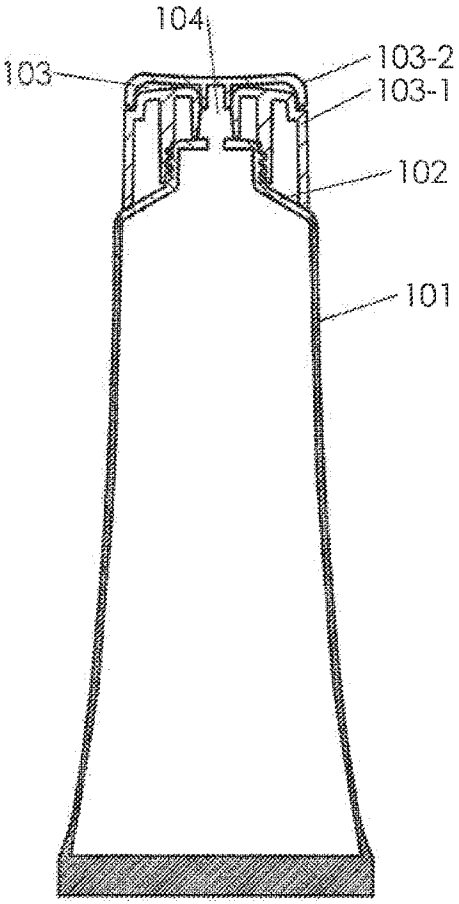
FIGS. 8A, 8B, 8C are cross-sectional views of a flexible tube of the related art, without a lid, equipped with a removable "screw"-type lid, and equipped with a fixed lid known as a "flip-top lid", respectively.
Figure 8B:
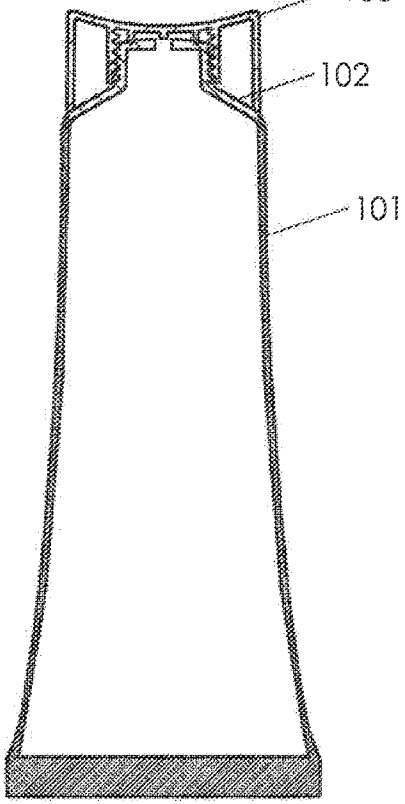
Figure 8A:
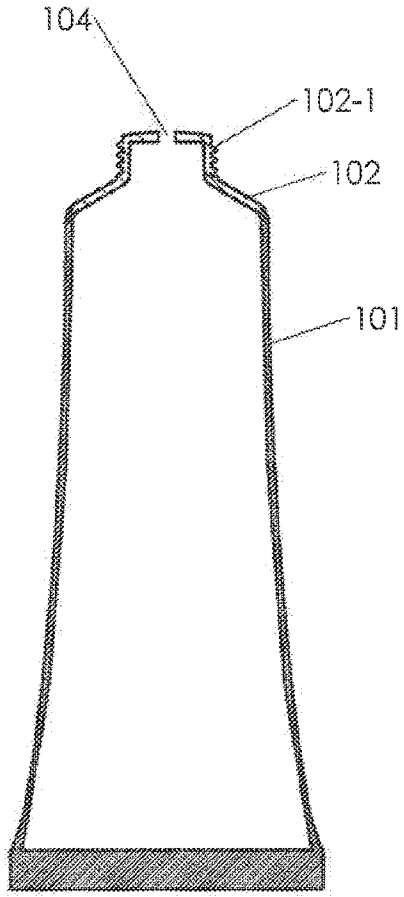

As can be seen in FIGS. 8A, 8B and 8C, the flexible tubes are generally made up of three constituents: a flexible body or skirt 101, a tube head 102 and a cap, that is to say a lid. The head of the tube is a rigid element having a fixing device or fixer 102-1 for the cap, the cap being able to be fixed, in the case of the "flip-top" cap 103 (FIG. 8C), or removable, in the case of the "screw" cap 105 (FIG. 8B).

When the tube is equipped with a cap 105, the head of the tube 102 forms a one-piece assembly incorporating the fixing device or fixer 102-1 of the removable cap 105 and delimiting the evacuation orifice 104 for the product contained in the tube. The orifice 104 is closed by screwing the cap 105 onto the head of the tube.

The fixed cap 103 is made up of two parts:

a first part, referred to as base 103-1, is permanently fixed to the tube by the fixing device or fixer 102-1, and a second part, referred to as cover 103-2, is fixed to the base 103-1 by a hinge.

In this arrangement, it is generally the wall of the base 103-1 which delimits the contour of the orifice 104. The cover 103-2 is free to pivot with respect to the base 103-1. In the open position, it frees up the orifice 104, and in the closed position (FIG. 8C), it closes the orifice 104.

The flexible tube according to some embodiments includes a valve housed in the orifice 104, the valve acting as a shut-off nozzle of the flexible tube.

Figure 9:
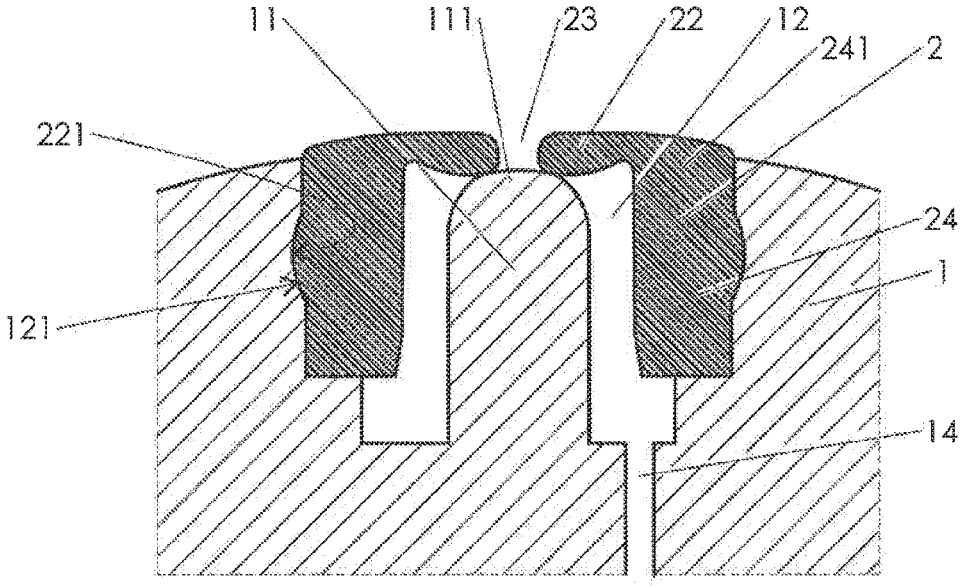
FIG. 9 is the detail of a cross section through a tube equipped with the valve of some embodiments according to a first variant.

In the first variant illustrated in FIG. 9, the airless flexible tube includes a valve housed in the orifice 104 delimited by the walls 102 or 103-1, depending on whether the tube is equipped with a removable cap 105 or a fixed cap 103. The valve acts as a shut-off nozzle for the tube. The free end 111 of the stem 11 and the face 121 act as a rigid support wall and a device or fixer for fixing the flap 2, respectively.

Figure 10:
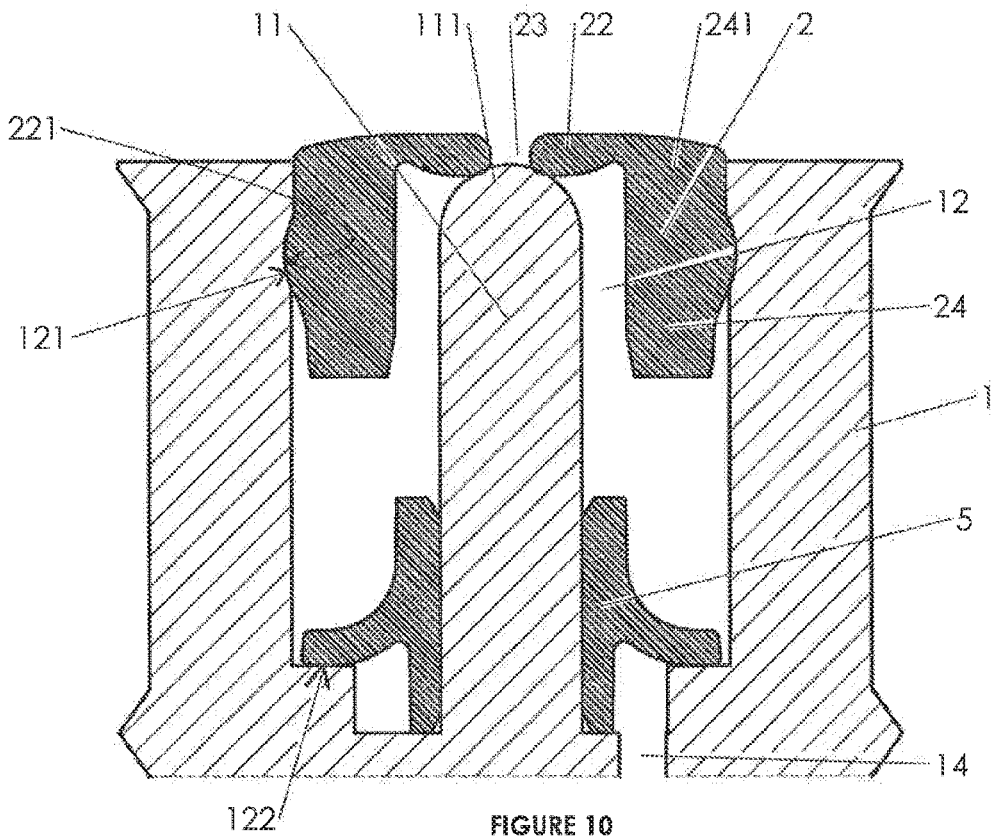
FIG. 10 is the detail of a cross section through a tube equipped with the valve of some embodiments according to a second variant.

In a second variant illustrated in FIG. 10, the nozzle 1 also bears a second flexible flap 5 that is fitted on the stem 11 and presses against the face 122 of the rigid wall situated at the bottom of the cavity 12 facing the first opening 13, the second flap 5 forming, with the nozzle 1, an additional non-return valve. This additional non-return valve and the valve forming the shut-off nozzle open and close at the same time depending on whether the user exerts a pressure on the wall of the tube or interrupts this pressure. The flexible tube thus has two barriers to the entry of air into the container, the two barriers being disposed "in series" with respect to one another. This embodiment is particularly economical since the rigid support walls and the device or fixer for fixing each flap are realized in the one-piece nozzle 1. The free end 111 of the stem 11 and the face 121 act as a rigid support wall and a device for fixing the flap 2, respectively, and the face 122 and the stem 11 act as a rigid support wall and as a device or fixer for fixing the flap 5, respectively.

The faces 121 and 122 and the stem 11 are part of the one-piece nozzle 1.

Advantageously, the nozzle 1 forms a one-piece assembly with one and the other of the walls of the head 102 or of the base 103-1 depending on whether the tube is equipped with a removable cap 105 or a fixed cap 103.

In a first version, the flap has an inside diameter of 6.50 mm and an orifice with a diameter of 0.60 mm. The stem has a diameter of 1.20 mm in the plane P.

The flap may be made of an elastomer of the SEBS, TPP or TEV type.

The nozzle does not have any specific mechanical properties and will be made of a rigid polymer of the polypropylene or HDPE (high-density polyethylene) type, or optionally made of polycarbonate.

The invention claimed is:

1. A valve for an airless dispensing system, comprising a rigid outlet nozzle that defines a center and having:

a stem at the center of the nozzle defining an axis;

and a flap, wherein:

the flap is in one piece and has a flexible wall situated facing a free end of the stem, the flexible wall is perforated by an orifice that is concentric with the free end of the stem and has a surface which is opposite to the end of the stem, the orifice of the flexible wall has a contour that is homothetic with the contour of the free end of the stem in a plane perpendicular to the axis of the stem, the orifice of the flexible wall has an area smaller than a projected area of the free end of the stem in the plane, the flap is connected to the nozzle by a non-deformable fixed connection, when no action is exerted on the valve, the flexible wall presses in an airtight manner against the free end of the stem at all points of the surface of the flexible wall in contact with the free end of the stem, thereby ensuring the air tightness of the nozzle and preventing penetration of air in the dispensing system through the valve, the pressing of the flexible wall against the free end of the stem is obtained by elastic deformation of the flexible wall, said elastic deformation resulting from the assembly of the flap and the nozzle, wherein the flap is equipped with a hollow shaft, a first end of which is joined to a peripheral region of the flexible wall, the flap is fixed to the nozzle by the hollow shaft being fitted into the cavity, along the axis, an outer face of the hollow shaft and an inner face of a wall of the cavity describing a annular axisymmetric shape cooperating with one another, the outer face pressing in a leaktight manner against the inner face of the wall of the cavity, the stem being disposed inside the hollow shaft and an inner face of the hollow shaft pressing against the flank of the stem.

2. The valve according to claim 1, wherein the nozzle forms a one-piece assembly.

3. The valve according to claim 1, wherein the flexible wall is inscribed in a convex cone of revolution, coaxial with the axis, an angle of the flexible wall with the axis being between 90° and 135, when the wall of the cavity is pressing against the free end of the stem.

4. The valve according to claim 1, wherein the orifice of the flexible wall and the projection of the free end of the stem in the plane have a circular shape.

5. A device of an airless flexible tube type having an orifice, comprising:

a valve according to claim 1 being housed in the orifice of the flexible tube and forming a shut-off nozzle of the flexible tube.

6. The valve according to claim 1, wherein the flap is made of an elastomer.

7. The valve according to claim 1, wherein the nozzle forms a one-piece assembly.

8. The valve according to claim 1, wherein the orifice of the flexible wall and the projection of the free end of the stem in the plane have a circular shape.

9. The valve according to claim 1, wherein the flexible wall of the flap has a convex conical shape when it presses against the end of the stem, exhibiting an angle of between 90° and 135° with the axis.

10. A valve for an airless dispensing system, comprising a rigid outlet nozzle that defines a center and having:

a stem at the center of the nozzle defining an axis;

and a flap, wherein:

the flap is in one piece and has a flexible wall situated facing a free end of the stem, the flexible wall is perforated by an orifice that is concentric with the free end of the stem and has a surface which is opposite to the end of the stem, the orifice of the flexible wall has a contour that is homothetic with the contour of the free end of the stem in a plane perpendicular to the axis of the stem, the orifice of the flexible wall has an area smaller than a projected area of the free end of the stem in the plane, the flap is connected to the nozzle by a non-deformable fixed connection, when no action is exerted on the valve, the flexible wall presses in an airtight manner against the free end of the stem at all points of the surface of the flexible wall in contact with the free end of the stem, thereby ensuring the air tightness of the nozzle and preventing penetration of air in the dispensing system through the valve, the pressing of the flexible wall against the free end of the stem is obtained by elastic deformation of the flexible wall, said elastic deformation resulting from the assembly of the flap and the nozzle, and wherein:

the stem is disposed inside—at the center of—a cavity pierced by a first opening, the free end of the stem being disposed at the center of the first opening, the first opening being inscribed in a plane perpendicular to the axis, the flap is equipped with a hollow shaft, a first end of which is joined to a peripheral region of the flexible wall, the flap is fixed to the nozzle by the hollow shaft being fitted into the cavity, along the axis, an outer face of the hollow shaft and an inner face of a wall of the cavity describing a annular axisymmetric shape cooperating with one another, the outer face pressing in a leaktight manner against the inner face of the wall of the cavity, the stem being disposed inside the hollow shaft and an inner face of the hollow shaft pressing against the flank of the stem.

* * * * *